United States Patent [19]

Rowe

[11] Patent Number: 4,578,129

[45] Date of Patent: Mar. 25, 1986

[54] OXYSULFIDE DISPERSION STRENGTHENED TITANIUM ALLOYS

[75] Inventor: Raymond G. Rowe, Schenectady, N.Y.

[73] Assignee: General Electric Company, Schenectady, N.Y.

[21] Appl. No.: 702,203

[22] Filed: Feb. 15, 1985

[51] Int. Cl.[4] ..... C22C 14/00; C22C 1/18

[52] U.S. Cl. ..... 148/407; 75/951; 420/417; 420/419

[58] Field of Search ..... 148/407; 420/417, 419; 75/951

[56] References Cited

U.S. PATENT DOCUMENTS 3,622,406 11/1971 Vordahl ..... 148/407

4,512,826 4/1985 Whang ..... 148/407

OTHER PUBLICATIONS

Sastry et al, "Structure and Properties of Rapidly Solidified Dispersion-Strengthened Titanium Alloys: Part 1, Characterization of Dispersoid Distribution, Structure and Chemistry", Metallurgical Transactions A, vol. 15A, Jul. 1984, pp. 1451-1463.

*Primary Examiner*—Veronica O'Keefe

*Attorney, Agent, or Firm*—Paul E. Rochford; James C. Davis, Jr.; James Magee, Jr.

[57] ABSTRACT

A titanium alloy base composition is prepared to contain a finely divided dispersoid of a compound which is stable in the alloy at elevated temperatures. The compound is of a metal and non-metal. The non-metal may be sulfide, oxysulfide or a combination of sulfide and oxysulfide. The compound metal may be at least one metal selected from the group comprising calcium, strontium and a rare earth metal selected from the group consisting of those rare earth metals having a chemical stability greater than that of the corresponding compound of yttrium.

7 Claims, 8 Drawing Figures

Ti-624 + Ce + S
AS EXTRUDED TENSILE

OXYSULFIDE DISPERSION STRENGTHENED TITANIUM ALLOYS

BACKGROUND OF THE INVENTION

The present invention relates to methods and means for strengthening titanium alloys for operation at higher temperatures. More particularly the invention relates to a method and means by which a titanium alloy is rendered capable of operating with good physical properties at temperatures above those at which the metal normally loses or otherwise loses its good operating physical properties.

At the present time titanium and its alloys can be used at temperatures up to about 1100° F. It is a superior metal exhibiting a good set of properties and many uses have been made of it for application at temperatures up to about 1100° F. If titanium could be modified so that its effective operating temperatures were above about 1100° F. it could be employed in the place of more expensive superalloys which are presently used in applications requiring the combination of high strength at high temperature. The superalloys are employed in the temperature range of over 1000° F. up to about 1700° F. Many applications exist for a metal having good strength and other properties in the temperature range of 1100°, to 1300° F. and if such a titanium alloy existed it could be substituted for more expensive superalloys presently employed in applications which require high strength at these temperatures.

The high reactivity of titanium and titanium alloys is manifested in its dissolution of most carbides, oxides, and other refractory compounds generally thought to have high chemical stability in other alloy systems. There has been much work to find ceramic compounds which resist dissolution by liquid titanium. All studies have concluded that every material which has been examined reacts with liquid titanium.

Recently, it has been found that rare earth additions to titanium produce stable sesquioxide compounds that have stability in the solid state in titanium alloys and which dissolve in the liquid state. This has been extended with rapid solidification processing by Sastry and co-workers to yield a find dispersoid of rare earth-based particles. This work is reported in an article by Sastry et al, entitled "Structure and Properties of Rapidly Solidified Dispersion Strengthened Titanium Alloys: Part 1. Characterization of Dispersoid Distribution, Structure and Chemistry" Met. Trans. A. Vol. 15A, pp. 1451–1463, 1984. Sastry et al have demonstrated the stability of these dispersoid particles to high temperatures. See in this regard SML Sastry et al "Dispersion Strengthened Powder Metallurgy Titanium Alloys" Final Report, Contract No. F33615-81-C-5011, Report AFWAL-TR-83-4092, October 1983.

It has been known heretofore that high temperature strengthening of conventional titanium alloys has been accomplished through solid solution strengthening techniques. This is brought out in the article by H. K. Miska appearing on pages 79 and 80 of the July 1974 issue of Materials Engineering under the title "Titanium and Its Alloys". There are several reasons why solid solution strengthening techniques have been employed. One reason is the high chemical stability of titanium solid solutions. These solutions exist as stable phases up to transformation temperatures on the order of 1700° F.

Solid solution strengthening has an apparent upper temperature limit for effective strengthening. Examination of the properties of current titanium alloys would lead one to the conclusion that the limit of titanium alloy strengthening is a result of this limitation of solution strengthening. One way of providing an increment of strengthening beyond solution strengthening is to add a precipitate or dispersoid phase to a solid solution strengthened alloy. It is known that the temperature dependence of dispersion strengthening is a weak function of temperature, varying only as the temperature dependence of elastic moduli. Dispersoid strengthening continues to be effective at temperatures beyond the temperatures at which solution strengthening is effective. Prior art examples of dispersion strengthened alloys in alloy systems other than titanium are the thoria-dispersion strengthened nickel alloys, and dispersion strengthened alloys produced by mechanical alloying. In all cases, the dispersoid phase is stable to temperatures far above the limit of solution or precipitation strengthened alloys. Unfortunately, for titanium alloys, the stability of most precipitate phases has been inadequate to prevent the dissolution or coarsening of the precipitate and aging of the material during high temperature service. This has been reported for several candidate precipitation strengthening systems by K. C. Anthony in a report AFML-TR-67-352 in November 1967 under the title "Dispersion Strengthened Alpha Titanium Alloys".

Further, the second phase compounds which could potentially serve as stable precipitate compounds are found to exhibit strong segregation during solidification thus limiting their usefulness as strengthening agents. Also the segregation results in the precipitation of large, blocky precipitate which not only do not contribute to strengthening but tend to weaken the alloy by providing sources of early crack nucleation. This is brought out in the report of K. C. Anthony above.

Furthermore, precipitation strengtheners such as $Ti_3Al$ exhibit slip localization due to the limited slip systems available in $Ti_3Al$. Slip localization leads to a low potential for work hardening and also leads to low ductility failures in alloys containing $Ti_3Al$. $Ti_3Al$ also exhibits inadequate thermal stability to prevent precipitation or re-precipitation during high temperature service of the alloy. The phenomenon of post creep embrittlement observed in many high temperature titanium alloys is attributed to the precipitation of $Ti_3Al$ along slip bands following creep exposure. Embrittlement of titanium alloys containing $Ti_3Al$ is thus due to the limited thermal stability of $Ti_3Al$.

It has been observed by Rath el al. in their publication "Influence of Erbium and Yttrium on the Microstructures and Mechanical Properties of Titanium Alloys", B. B. Rath, B. A. MacDonald, S. M. L. Sastry, R. J. Lederich, J. E. O'Neal, and C. R. Whitsett, in Titanium '80, Editors H. Kimura and O. Izumi, Proc Fourth Int'l Conf on Titanium, Kyoto, Japan, May 1980, Met Soc AIME, 1980 that the addition of rare earth metals, typically Er, Gd, Y and others, produce a dispersoid which is stable to temperatures as high as 1472° F. Sastry further observed that rapid solidification of these alloys from the melt prevented gross segregation of these alloying elements, and formed a fine, uniform distribution of dispersoids.

Further, Sastry has reported a significant beneficial strengthening effect due to the formation of this fine rare earth dispersoid. It is believed that a fine dispersoid is required to achieve a small spacing between particles on any plane in the alloy in order to achieve significant strengthening. It is also believed that a beneficial strengthening effect drops off rapidly as the size of the particles increases by the process of solid state particle coarsening. It is for this reason that the thermal stability of the dispersoid must be such that particle coarsening is minimized during high temperature exposure.

The rare earth sesquioxides, $Er_2O_3$ and $Y_2O_3$ have been identified to be the stable dispersoid phases in titanium alloys containing Er or Y, respectively. The above article by Sastry reports coarsening of dispersoids formed by the addition of the rare-earth elements Er, Nd, Dy, Gd, Y, and Ce in titanium containing impurity oxygen in an amount sufficient to create rare earth oxide compounds. It has been found that the alloy Ti-Er produces the dispersoid with the greatest resistance to coarsening at high temperatures. This alloy exhibited only modest coarsening at 800° C., but in 45 minutes at 900° C., particle coarsening was observed from a mean particle diameter of 450A to a mean diameter of 680A. The loss in dispersoid strengthening resulting from this coarsening amounts to approximately 20%. I have examined a titanium base alloy with a composition as follows:

Ti-6W/o, Al;2w/o, Sn;4w/o, Zr;2w/o, Mo;1w/o, Er;0.25w/oB, and the balance titanium.

In this composition description w/o stands for weight percent. This composition also contained $Er_2O_3$ dispersoid particles dispersed therein. The composition exhibited particle coarsening after a one hour anneal at 950° C. This particle coarsening was accompanied by an increased mean interparticle spacing from 0.67 micrometer to 1.87 micrometer. The reduction in strengthening due to the Orowan-Ashby model was 46%. Because of the need to minimize particle coarsening, Sastry reported that his consolidation techniques were carried out at 820°-850° C.

These observations point out the critical importance that dispersoid particle stability makes in the ability to process alloys at elevated temperatures and in the ability of the alloy to withstand long term exposure at somewhat lower temperatures.

The thermodynamic stability of rare earth oxides is great enough so that the equilibrium vapor pressure of oxygen in equilibrium with them at temperature up to the melting point of titanium is so small that in an ideal solid solution, the concentration of oxygen in solution in the alloy required to stabilize the oxide is so small it would be unmeasurable by conventional analytical techniques. This stability is the basis for the use of oxide ceramics for the containment of most liquid metals. Titanium is far from an ideal soild solution, however, and the free energy of solution of oxygen in titanium solid solution is on the order of −125 Kcal/mole at low oxygen concentrations. For an ideal solid solution, the excess free energy of solution is zero. The standard free energy of formation of the oxide compound, $TiO_2$, is −112 Kcal/mole. Subtracting the excess free energy of solution of oxygen in titanium (−97 Kcal/mole), one can see that the net free energy of formation of the reaction of $TiO_2$ with titanium solution of oxygen at low concentrations is very small. Solid solution of oxygen in titanium is hence more energetically favored than the oxide for oxygen concentrations below a few percent oxygen.

Although the heat of solution of oxygen in titanium reduces the negative free energy of reaction of most rare earth oxides in equilibrium with titanium, most rare-earth oxides are energetically favored at some low oxygen content of the solid solution. This is verified by the experimental results of Sastry et al, who have established the practical stability of $Er_2O_3$ and other rare earth oxide compounds to temperatures as high as 850° C.

Rare earth element additions have been shown to produce fine precipitate dispersions based upon the isolubility of rare earths such as erbium and terbium in titanium. Rapid solidification processing has been shown to be required to produce this dispersion. This information was presented at the poster session of the National Bureau of Standards Conference on Rapid Solidification technology, December of 1982 and in written reports by S. Sastry. The stability of the dispersoids produced by these rare earth additions appears adequate for short-term exposure to temperatures in the neighbor range of 800° C. but this temperature may not be adequate to allow high temperature consolidation of these alloys or may limit their maximum surface temperature.

Sulfur is generally avoided as a tramp element in titanium alloys. This is because of the potential for the formation of titanium sulfides which would lead to embrittlement in service. I have found that in the presence of rare earth elements in solution, the equilibrium concentration of sulfur may be maintained below the level for precipitation of $Ti_5S$ or other titanium sulfides. It is known that manganese can be added to steels to eliminate the embrittling effect of residual sulfur by the formation of MnS. D. F. Stein, "Reversible Temper Embrittlement", Ann. Rev. Mater. Sci., Vol. 7, pp. 123-153, 1977.

I have examined dispersoid compounds in systems other than pure oxide compounds in order to identify a dispersoid compound which has greater thermal stability and hence a greater resistance to high temperature exposure than these sesquioxide compounds. It is well known that in equilibrium with their own vapor pressure, no compounds are known which have greater high temperature thermodynamic stability than the oxides of the rare earths. Their stability in equilibrium with solid titanium depends also on the excess free energies of solution of oxygen and the rare earth element with a titanium solid solution. Because of this, chemical compounds which have a lower free energy of formation in equilibrium with their own vapor pressure could have greater stability in equilibrium with a titanium solid solution. This could occur if the heat of solution of its constituent elements were less than that of the rare earth oxides. The compounds which have their own thermodynamic stability second only to the rare earth oxides are the rare earth oxysulfides.

I have observed that cerium sulfides and oxysulfides produce a fine dispersoid when added to titanium alloys and rapidly solidified from the melt.

I have now observed that rapid solidification technology applied to alloys containing cerium and sulfur additions offers a new opportunity for titanium alloy development. Pursuant to this I have found that by rapidly solidifying an alloy from the liquid state these new dispersion strengthening elements may be introduced into the alloy without the problem of coarse segregation zones of precipitation as has been observed in the prior art as discussed above. I find that dispersion strengthening compounds must have the characteristic that during or after solidification a fine particle dispersion is produced and in addition I have observed that such find particle dispersion must be thermodynamically or kinetically stable.

Further, I have observed that sulfides and oxysulfides of certain rare earth element additions are found to produce fine precipitate dispersions based upon the insolubility of the sulfides and oxysulfides of rare earths such as cerium in titanium. It has now been observed that rapid solidification processing is required to produce this dispersion.

The stability of the dispersoids produced by these rare earth sulfide and oxysulfide additions appears adequate for short term exposure to temperatures in the range of 950° to 1000° C. This is at least 100° C. higher than the capabilities of dispersion strengthened alloys containing only rare earth additions which produce dispersoids of the sesquioxide type compounds.

BRIEF SUMMARY OF THE INVENTION

It is accordingly one object of the present invention to provide strengtheners for titanium base alloys which have greater thermal stability than the previously used solution strengtheners.

Another object is to provide particulate strengtheners for titanium alloys which do not contain solution strengtheners.

Another object is to provide strengtheners for a variety of titanium alloys.

Another object is to provide a means and method by which the service temperature of titanium base alloys may be appreciably increased.

Another object is to provide a composition of titanium base metal having stable dispersed strengthening or stabilizing agents.

Another object is to provide very fine strengthening dispersions for titanium base alloys which have significant stability.

In one of its broader aspects the objects of the present invention are accomplished by providing titanium base alloys having rare earth sulfides and/or oxysulfides. Specific rare earth sulfides and oxysulfides which are useful in practicing the present invention include the sulfides and oxysulfides of cerium.

It is within the scope of the present invention to include dispersion strengthening precipitates within a solution strengthened titanium alloy matrix.

BRIEF DESCRIPTION OF THE DRAWINGS

The description of the invention which follows will be made clearer by reference to the accompanying drawings in which.

DETAILED DESCRIPTION OF THE INVENTION

Figure 1:
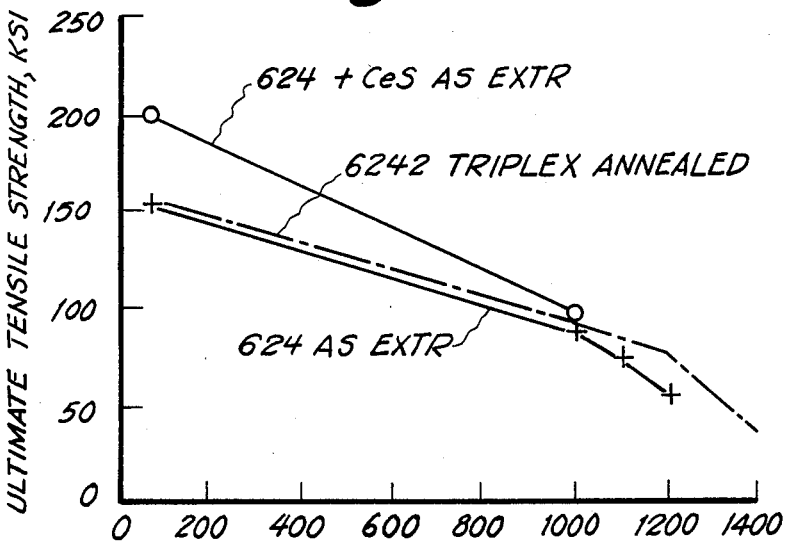
FIG. 1 is a graph plotting ultimate tensile strength in ksi against temperature in degrees Fahrenheit for certain metal samples.

Rare earth sulfides are among the most chemically stable compounds and are interpreted by some to be next to oxides in order to stability. In titanium alloys, sulfides and oxysulfides have been found to have good stability as dispersoids.

The alloys which I have invented utilize cerium sulfide, cerium oxysulfides, and other rare earth sulfur bearing compounds to form fine dispersoids in otherwise conventional titanium alloys. The dispersoid bearing alloys provide incremental strengthening over that provided by conventional alloying.

In addition, these additions produce a dispersoid of similar distribution and thermal stability in a number of different solid solution strengthened alpha-titanium and alpha-beta titanium alloys. The benefit of adding strength in addition to that provided by the conventional addition of solid solution strengthening and alpha-beta transformation strengthening is manifested at temperatures as high as 1200° F. The dispersoid containing alloys based upon cerium sulfide and oxysulfide have been found to exhibit greater stability in maintaining a fine dispersoid in the alloy than alloys based only upon rare earth oxide dispersoids for high temperature thermal exposure at temperatures just below the alpha titanium transus temperature.

Sulfur is generally avoided as a tramp element in titanium alloys. This is because of the potential for the formation of titanium sulfides which could lead to embrittlement in service. In the presence of rare earth elements in solution, the equilibrium concentration of sulfur may be maintained below the level for precipitation of sulfur compounds of titanium.

In the specification which follows I describe experimental details of titanium alloys having a fine dispersoid ranging in size from 50 to 3000 Angstrom diameter and distributed uniformly throughout the titanium base alloy. The alloys described utilize cerium sulfide, cerium oxysulfides, and other rare earth sulfur bearing compounds to form fine dispersoids in otherwise conventional titanium alloys. The dispersoid bearing alloys provide incremental strengthening over that provided by conventional alloying.

In addition, these additions produce a dispersoid of similar distribution and thermal stability in a number of different solid solution strengthened alpha-titanium and alpha-beta titanium alloys.

I have found that by adding strength to these alloys as an addition to that provided by conventional addition of solid solution strengthening and alpha-beta transformation strengthening permits strength to be achieved to temperatures as high as 1200° C. The dispersoid containing alloys based cerium sulfide and oxysulfide have been found to exhibit greater stability in maintaining a fine dispersoid in the alloy than alloys based on only rare earth oxide dispersoids for high temperature thermal exposure at temperatures just below the alpha-titanium transus temperature.

EXAMPLES

The compositions of titanium base alloys prepared according to the examples of this application are listed in Table I. The alloy matrix compositions were based upon highly alloyed heat stable alpha-titanium and alpha-beta titanium formulations with alloy levels typical of high temperature titanium alloys. The alloys prepared are set out in Table I as follows:

TABLE I

| Alloy | Composition | Ti | Al | Zr | Sn | Mo | Ce (Other) | S | O |
|---|---|---|---|---|---|---|---|---|---|
| TIX83 | (Aim) | Bal | 6 | 6 | | | 1 | .15 | .13 |
| | (Analysis) | | 5.4 | 5.7 | | | 0.75 | .09 | .13 |
| TIX136 | (Aim) | Bal | 6 | 2 | 4 | | | | |
| | (Analysis) | | | | | | | | |
| TIX136 | (Aim) | Bal | 6 | 2 | 4 | | 1 | .15 | |
| | (Analysis) | | | | | | | | |
| TIX138 | (Aim) | Bal | 6 | 2 | 4 | 2 | .9 | .12 | .24 |
| | (Analysis) | | | | | | | | |
| TIX151 | (Aim) | Bal | 6 | 2 | 4 | | 3 | .15 | |
| | (Analysis) | | | | | | | | |
| TIX153 | (Aim) | Bal | 6 | 2 | 4 | | 4.5 | .15 | |
| | (Analysis) | | | | | | | | |
| TIX152 | (Aim) | Bal | 6 | 2 | 4 | | 4.5 | .3 | |
| | (Analysis) | | | | | | | | |
| TIX139 | (Aim) | Bal | 6 | 2 | 4 | 2 | 4.5 | .8 | |
| | (Analysis) | | | | | | 3.7 | .5 | .2 |
| TIX84 | (Aim) | Bal | 6 | 6 | | | 1(Er) | .15 | |
| | (Analysis) | | | | | | | | |
| TIX154 | (Aim) | Bal | 6 | 2 | 4 | | 1.5(Y) | .15 | |
| | (Analysis) | | | | | | | | |

EXAMPLE A

A titanium base alloy was prepared to contain 6 weight % aluminum and 2 weight % zirconium and 4 weight % tin. The alloy did not contain any cerium or sulfur as additives. The sample is identified as alloy TIX136 in Table I above.

The alloy was prepared to provide a comparison between alloys free of cerium sulfide and cerium oxysulfide and other alloys which do contain cerium sulfide and cerium oxysulfide. The cerium free sample of this example was prepared to provide a basis for comparison with other cerium bearing alloys. The comparison with other cerium bearing alloys related to the properties exhibited by an alloy free of cerium and sulfur and one containing the cerium and sulfur distributed in the host alloy as fine particles. The comparison was also of the degree of dispersion and the degree of stability of rare earth sulfides in a highly solution-strengthened titanium alloy matrix.

The alloy was prepared by arc melting a melt button. The button was flipped several times to homogeneously melt the alloy and to enhance uniformity of ingredient distribution. The button melt was then drop cast into a copper chill mold to produce alloy sticks. The rod was then used in a melt extraction process as described in copending application for patent Ser. No. 665,901 filed Oct. 29, 1984 and assigned to the same assignee as the subject application. The text of this application is incorporated herein by reference. In general the alloy sticks were electron beam melted and melt extracted in vacuum using a copper wheel rotating at an edge speed of approximately 12 meters per second.

The process used is a so called pedestal drop melt extraction process. In this process the rod is mounted essentially vertically and the top of the rod is heated to melt only its uppermost end. Melt is extracted from the rod end by bringing the end into contact with the edge of a rapidly spinning wheel. As the drop at the top of the rod is extracted by the edge of the wheel the continuous application of heat to the rod end causes more of the rod end to melt and this supplies additional melt for extraction by the wheel edge. The process may then be made continuous by a proper balance of the rate of melting the rod end and the rate of extracting the melt from the rod end by casting onto the edge of the rapidly rotating wheel.

The apparatus, which has been found preferable for the melt extraction of titanium alloys, and essential for the melt extraction of a certain group of titanium alloys, has a wheel of molybdenum as is explained in the copending application reference immediately above.

The product formed by the melt extraction process was a fiber or filament form of the alloy. Once the melt extracted product is formed it must then be consolidated into a solid form in order that tests can be made of the properties of the solid.

Consolidation is accomplished by first cold pressing the filamentary sample into low carbon steel HIP containers. The samples are then subjected to the so called HIP, or hot isostatic pressing, process. According to this process the sample to be consolidated is first enclosed within a metal container, the container is sealed and isostatic pressure is applied to and through the container at high temperature to cause the filamentary alloy to consolidate into a solid body. In this example the filamentary sample was HIPed at 850° C. for three hours at 30 ksi pressure.

The HIP can was next removed and the HIPed consolidated alloy sample was machined to a uniform cross section. The alloy sample was found to exhibit some porosity after being HIPed. This was attributed to leakage of the HIP container. A specimen was prepared from the HIPed sample for tensile testing despite the fact that the small pores in the consolidated alloy could be expected to reduce the apparent strength and ductility of the alloy. The test results are reported below.

The alloy was then extruded to form a bar at a reduction ratio of 7:1 at a temperature of 850° C. to form a bulk form of the alloy. Tensile specimens were machined from the extruded bar. Room temperature testing was performed in air. High temperature tensile testing was performed in vacuum. The tensile strength of the alloy over the temperature range of room temperature to 1200° F. are shown in FIG. 1 in data points of the lowermost plot marked with the plus sign, +.

The alloy Ti-624, of this example had an all alpha-titanium structure which is roughly equivalent to the alpha-titanium phase of alloy Ti-6242. Alloy Ti-6242 is an alpha-beta titanium base alloy for high temperature applications which contains 6 weight percent aluminum, 2 weight percent zirconium, 4 weight percent tin and 2 weight percent of molybdenum.

The titanium base alloys also contain small amounts of other elements such as chromium, iron and aluminum and the like as impurities. These are impurities customarily found in high temperature alloys and in titanium alloys in particular at trace levels. The term "titanium composition" or "titanium base alloy" as used in the specification and claims of this application has this meaning; namely, that the composition or alloy may contain low levels of impurities conventionally found in such compositions or alloys.

The tensile strength of the titanium base alloy Ti-6242 in the conventional triplex annealed condition is included as the dashed curve of FIG. 1 and is so marked. In the examples which follow the term "w/o" means weight percent and the term "a/o" means atomic percent.

EXAMPLES B

In the following examples the reference to an alloy by a TIX member refers to the composition as set forth in Table I.

To the above alloys we have added, as indicated, cerium and other rare earth elements to form stable dispersoids for strengthening the alloy and provide an additional means of alloy microstructure control. In many of the alloys we measured approximately 0.1 weight percent (0.3 atomic percent) of oxygen as a residual contaminant. In alloys containing 1–2 weight % cerium, this amount of oxygen was usually sufficient to tie up all of the cerium or other rare earth elements which were added, as a combination of oxides and oxysulfides. Because of this reaction with oxides, the reactions leading to the formation of dispersoid should involve all three elements, namely cerium, sulfur and oxygen. Although the titanium alloys contained aluminum, zirconium, tin, and other alloy additions, I found no evidence of these elements in the dispersoid.

The procedures used in these examples are substantially the same as those described above in Example A above.

EXAMPLE #1

The microstructure of as-melt-extracted filament indicated little segregation during solidification, although precipitation of fine dispersoids was detectable by transmission electron microscopy and STEM. The as-solidified ingot microstructure was heavily segregated with every internal boundary covered with a dark etching phase. The microstructure of rapidly solidified alloy TIX83 could not be resolved by optical metallography because its features were finer than that which optical metallography could detect. The microstructure was characteristic of the transformation of beta titanium to alpha-prime martensite. There is little evidence of the solidification structure even by scanning electron microscopy because of the martensitic transformation, and because there was no evidence of chemical segregation at solidification boundaries. The pattern of the transformed grains and striations in the background of the micrograph suggested columnar solidification from the bottom to the top of the filament. The thickness of filaments was typically 50 to 100 microns. Some filaments were found with a microstructure which did not appear to be generated by unidirectional solidification. These filaments had heavy precipitation of a sometimes continuous precipitate phase at grain boundaries near the top of the filament. This suggested that the solidification conditions of filaments were not always uniformly rapid.

EXAMPLE #2

Figure 7:
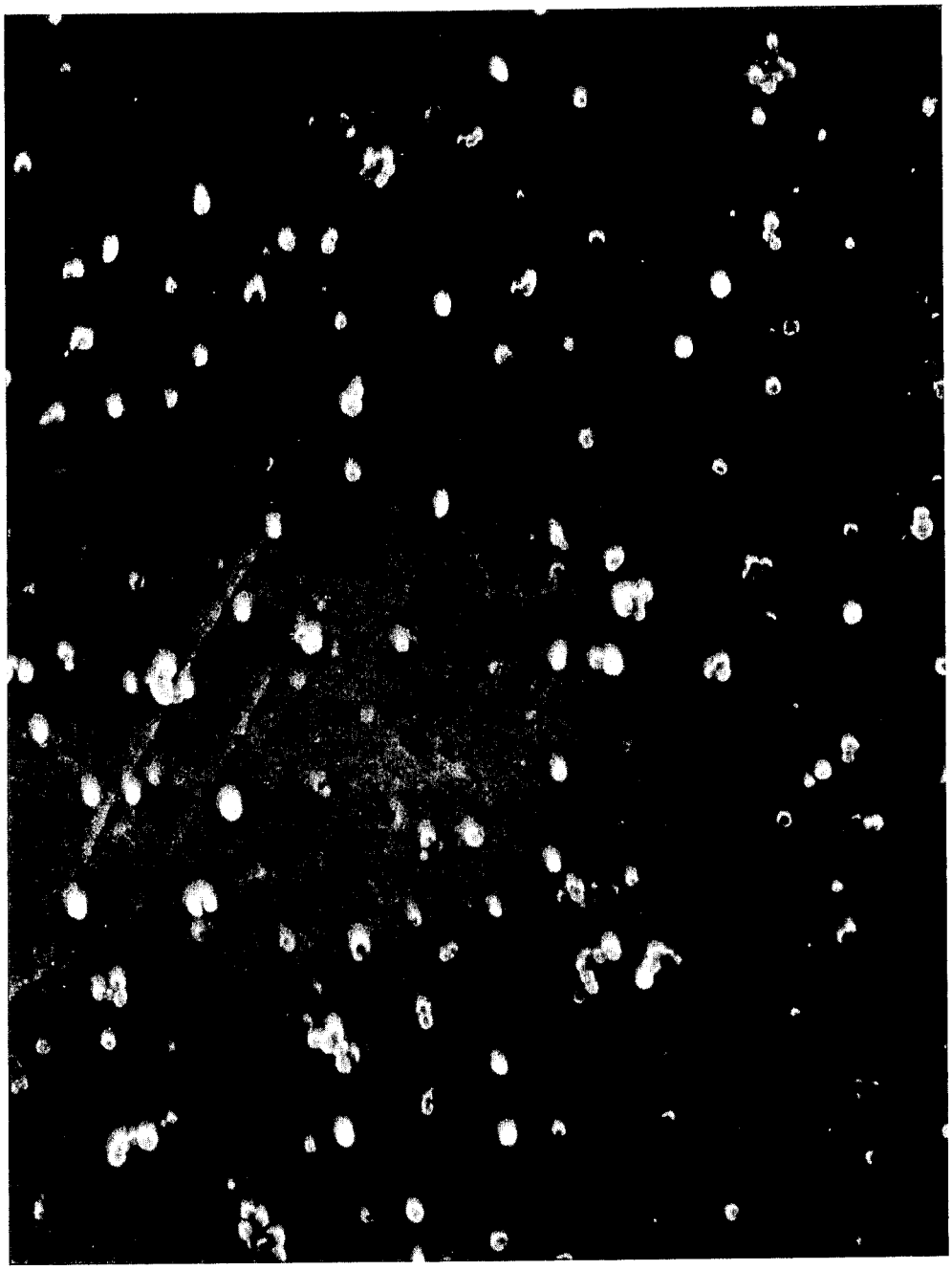
FIG. 7 is an electron back reflection scanning transmission electron micrograph at a magnification of 40,000× of a thin foil section of an alloy EB 83 etched to expose dispersoid particles. Average particle diameter for this sample is observed to be approximately 500 to 1000 Angstroms. Particles are observed to be spaced approximately 0.4 to 0.5 micron apart.

Transmission electron microscopy of a thinned filament of alloy TIX83 revealed precipitation of dispersoid particles in the as-melt-extracted filament. Some particles were aligned in rows suggested precipitation at internal boundaries. Other areas showed higher density precipitation, but also with evidence of aligned particles which may have precipitated along cellular solidification boundaries. Particles were characteristically rounded or elliptical with an average diameter of 740 Angstrom. Smaller particles appeared to have some faceted edges with rounded corners. An electron back reflection micrograph obtained from the surface of an electropolished TEM foil is shown in FIG. 7. The density of particles intersecting the electropolished surface was 9.7 million particles/mm$^2$.

EXAMPLE #3

Melt extracted ribbon of alloy TIX83 was cold pressed into a low carbon steel HIP container, HIPed at 850° C. for 3 hrs, and extruded 7:1 at 850° C. to form bulk alloy, following a procedure which has been developed for rapidly solidified titanium alloys. The alloy was full density with no evidence of prior filament boundaries in the consolidated material. Samples were heat treated at 750° C. for 24 hrs to evaluate the thermal stability of the dispersoid after exposure to temperatures in excess of any potential titanium alloy service temperature. The dispersoid particles appeared to have a wide size distribution, which was bimodal with very large particles ranging from 1000–3000 A mixed with very small particles less than 250 A diameter. The matrix alloy structure was identified by electron diffraction to be hexagonal alpha titanium.

EXAMPLE #4

Alloy TIX137 had a base alloy composition of Ti-624 with additions of 1 w/o Ce, 0.15 w/o S and residual oxygen at approximately 0.1 w.o. Transmission electron microscopy of this alloy showed that after rapid solidification and consolidation at 850° C. by the same HIP plus extrusion process described above, the alloy had a fine dispersoid with particle diameter of 300 to 750 Angstrom [1314-A1E]. Intersection of particles with the electropolished foil surface indicated a dispersoid density of 2.8 million particles/mm$^2$. [1314A1Q]

EXAMPLE #5

Energy dispersive analysis of a particle in the as-melt extracted filament of alloy TIX83 showed that dispersoid particles had a high concentration of cerium and sulfur Quantitative comparison of the Ce:S x-ray signal intensities, corrected for peak overlap and sensitivity differences indicated a 1:1.36 atomic ratio of cerium to sulfur. The compound CeS has a 1:1 Ce:S ratio, $Ce_2S_3$ is 1:1.5, $Ce_2O_2S$ is 1:0.5, and $Ce_4O_4S_3$ has a 1:1.33 ratio. The measured ratio is closest to that of $Ce_4O_4S_3$, and does not appear to be consistent with $Ce_2O_2S$.

Selected area electron diffraction of dispersoid particles resulted in diffraction patterns that were consistent with the presence of $Ce_4O_4S_3$,CeS, and $Ce_3S_4$. Diffraction patterns were identified which were consistent an orthorhombic crystal structure with a=6.851 A, b=14.529 A, C=3.958 A. This corresponds to $Ce_4O_4S_3$ as described in an article by J. Dague et al, Acta. Cryst. Alloy, Sec. B, Vol. 34, p. 3564, 1978. Others were cubic with a lattice parameter of a=5.778 A, the structure of CeS as described by Zachariesen, Act. Cryst. Alloy, Vol. 2, p. 293, 1949 and also in Vol. 1, p. 265, 1948 and further in Vol. 2, p. 57, 1949. The third structure identified was cubic crystal structure with a lattice parameter a=6.36 A, which may either be $Ce_3S_4$ as noted in Vovan, Tien, and Khodadad, Bulletin Soc.

Chem. Fv. p. 30, 1969 or $Ce_2S_3$ as described in Zachariesen noted above.

EXAMPLE #6

Alloy TIX137, described earlier, with a base alloy composition of Ti-624 with additions of 1 w/o Ce, 0.15 w/o S and residual oxygen at approximately 0.1 w/o was examined by selected area electron diffraction for particle identification. A consolidated alloy sample from the end of a tensile test specimen showed CeS and $Ce_4O_4S_3$ as dispersoid species. There was no evidence of any titanium sulfide phase.

EXAMPLE #7

Alloy TIX83 with Ti-6 w/o Al-6 w/o Zr base composition plus 1 w/o Ce, 0.15 w/o S, and 0.13 w/o O (typical residual oxygen level) showed no segregation either after rapid solidification or after a 950° C. anneal, indicating that the normally precipitating titanium sulfide phase, as described by Ageev in Phase Diagrams in Metals (Russian) Moscow, 1973, is thermodynamically prevented by the formation of the more stable cerium sulfide or oxysulfide phases.

The dispersoid size distribution in the consolidated alloy TIX83 indicated the good stability of the dispersoid to consolidation processing at a temperature of 850° C. Melt extracted filaments of a number of different alloys and dispersoid levels were annealed at an even higher temperature, 950° C., to evaluate dispersoid stability during high temperature exposure. The temperature of 950° C. is far higher than needed for consolidation, but within the temperature range which may be utilized for such additional processing as grain growth, etc.

EXAMPLE #8

Consolidated Alloy TIX137 (Ti-624+1 w/o Ce+0.15 w/o S+0.1 w/o O) was annealed for one hour at 1000° C. Dispersoid size was bimodal in this sample, with dispersoids near grain boundaries appearing to be significantly larger than those in grain interiors. The particles at grain boundaries had coarsened to 1500 Angstrom diameter or larger, and the resultant interparticle spacing was much larger. At 1000° C., some beta phase may have been present in alloy TIX137, as determined from the binary titanium-aluminum phase diagram as described by Schull et al in "Phase Equilibria in the Titanium-Aluminum System" to appear in Proceedings of the 5th International Conference on Titanium, Munich, FRG. 1984. Beta phase has been shown to exhibit significantly faster dispersoid coarsening than for equivalent conditions in titanium alpha phase as brought out by D. G. Konitzer et al in "Refined Dispersion of Rare Earth Oxides in Ti-Alloys Produced by Rapid Solidification", Oral Presentation: Fifth International Conference on Titanium, Munich, FRG, September 1984. To be published.

The average particle diameter for dispersoid particles in grain interiors was on the order of 400 Angstrom or even less. [1371A1E] Although the dominant number of dispersoid particles in this alloy ranged in size from 250 to 1500 Angstroms in diameter, some regions of the specimen exhibited local regions where the dispersoid particle diameter was on the order of 75 to 100 Angstrom, with mean interparticle separation on the order of 0.05 micron [1371A1E]. This result showing less than 400 Angstrom dispersoids after a high temperature anneal at 1000° C. demonstrates the extraordinary thermal stability of the dispersoid based upon cerium and sulfur additions in an alpha-titanium matrix.

The variability in dispersoid particle diameter depends upon variations in the quench rate of solidification and cooling, and the details of the alloy microstructure during heat treatment. The quench rate can be increased by solidifying the filament to a thinner average dimension or by increasing the efficiency of heat extraction from the filament during solidification and cooling. Thus, the lower bound of dispersoid particle sizes appears to be at least on the order of the 75 to 100 Angstrom particle size observed in this specimen, or perhaps smaller.

EXAMPLE #9

Alloy TIX84 with Ti-6 w/o Al-6 w/o Zr base composition plus 1 w/o Er and 0.025 w/o S. Residual oxygen was 0.11 w/o. This alloy was homogeneous after rapid solidification, but showed segregation of a continuous phase at grain boundaries after annealing at 950° C. The same segregation is not present in other alloys containing the same erbium and oxygen levels but no sulfur addition.

Figure 5:
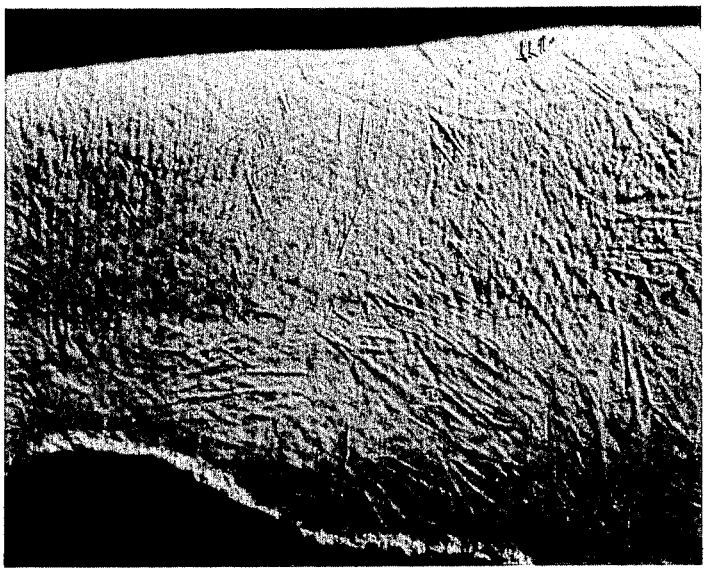
FIG. 5 is an optical micrograph of a cross-section of a cast ribbon of alloy EB 84 at a magnification of 1360×.

The as-cast microstructure of both alloys EB 83 and EB 84 exhibited little evidence of a dispersoid or second phase compounds when observed by optical metallography. Typical of the featureless, martensitic-type microstructure of these two alloys is the optical micrograph of alloy EB 84 shown in FIG. 5.

Figure 6:
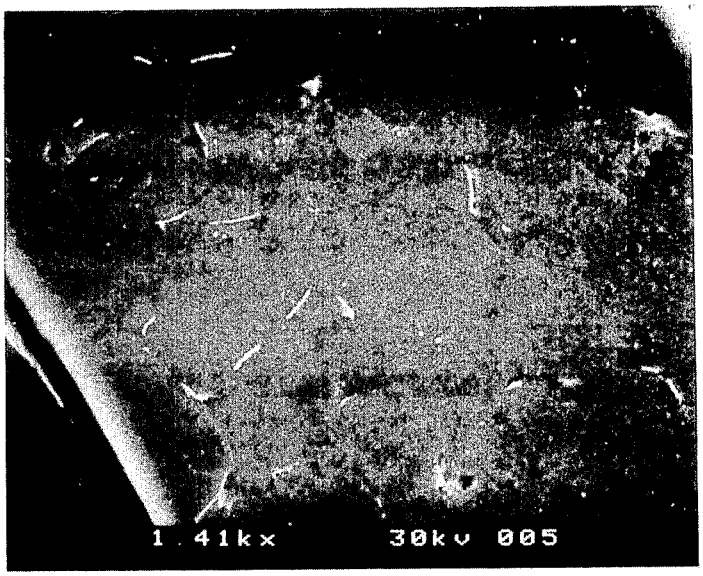
FIG. 6 is a scanning electron micrograph at a magnification of 1530× of a cross-section of a ribbon of alloy EB 84 after heat treatment at 950° C. for one hour. The figure shows the precipitation of second phase platelets along grain boundaries and suggests significant dissolution of the initial dispersoid compound.

The thermal stability of these two alloys was evaluated by annealing melt extracted ribbon in an argon atmosphere at a temperature of 950° C. for one hour at temperature. Alloy EB 84, the alloy with erbium and sulfur additions, exhibited grain coarsening and precipitation of a planar precipitate phase along grain boundaries. This is shown in FIG. 6. This microstructure is characteristic of an alloy with a highly mobile solute species in equilibrium with a thermally unstable phase. During heat treatment, sulfur exists in sufficiently high concentration to migrate to internal boundaries and reprecipitate (presumably as a titanium sulfide). This suggests that the compound of erbium and sulfur in alloy EB 84 does not have sufficient stability for high temperature exposure. Furthermore, it demonstrates that free sulfur in a titanium alloy can result in severe embrittlement after thermal exposure due to this reprecipitation along internal boundaries.

EXAMPLE #10

Alloy TIX154 with Ti-624 base composition plus 1.5 w/o Y and 0.15 w/o S was prepared to evaluate the stability of alloys containing yttrium instead of cerium as the rare earth element. This alloy exhibited no segregation as rapidly solidified and after the 950° C. anneal indicating the stability of oxygen and sulfur bearing compounds in a titanium alloy matrix, and the resistance of any excess yttrium to melting at 950° C.

EXAMPLE #11

Alloy TIX138 with a Ti-6242 (Ti-6Al-2Sn-4Zr-2Mo) base composition and 1 w/o Ce plus 0.15 w/o S showed no instability after a 950° C. anneal. This alloy had an alpha-beta matrix structure and showed that the presence of the body centered cubic beta phase does not result in the appearance of unstable phases at grain boundaries or other internal surfaces.

Alloys with a base alloy composition of Ti-624 (Ti-6 w/o Al-2 w/o Sn-4 w/o Zr) were prepared with cerium additions ranging from 1 to 4.5 w/o cerium and sulfur from 0.15 w/o to these alloys were annealed at a high temperature to evaluate alloy stability during high temperature exposure such as that which might be experienced during consolidation of a powder or other rapid solidification particulate compact to produce a high integrity alloy component.

EXAMPLE #12

Alloy TIX151 with a matrix of Ti-624 with 3 w/o Ce and 0.15 w/o S exhibited segregation at all solidification boundaries as rapidly solidified by pendant drop melt extraction. After 950° C. annealing, a continuous layer of a precipitate phase appeared at grain boundaries. [57909A1C] The atomic percentages of Ce, S, and O can be calculated to be 1.1, 0.22, and 0.4, respectively. There should be excess cerium in this alloy over that required to form sulfides and oxysulfides.

EXAMPLE #13

Alloy TIX153 with Ti-624 base composition plus 4.5 w/o Ce and 0.15 w/o S exhibited less as-solidified segregation after rapid solidification by pendant drop melt extraction, but severe segregation of a continuous phase at grain boundaries following at 950° C. anneal for one hour. The atomic percentages of Ce, S and O for these levels are 1.56, 0.22, and 0.4 respectively. This suggests excess cerium which could account for the presence of the unstable phase at grain boundaries.

EXAMPLE #14

In contrast to the behavior of alloys TIX151 and TIX153, alloy TIX152 with Ti-624 base composition plus 4.5 w/o Ce and 0.3 w/o S exhibited no detectable segregation either after rapid solidification or after the 950° C. anneal The atomic fraction of sulfur was doubled in this alloy over that of alloy TIX153, above. One still would expect some excess Ce, but there was apparently enough sulfur and oxygen to prevent detectable excess cerium instability.

EXAMPLE #15

Alloy TIX139 with a Ti-6242 base composition and 3.7 w/o Ce plus 0.5 w/o S and 0.2 w/o O showed no grain boundary phase after a 950° C. anneal. Some scattered spherical particles were observed, but these were randomly scattered throughout the cross section suggesting that they may have been a result of inadequate melting time during melt extraction. That a continuous grain boundary phase was not observed suggested that for this alloy which had atomic percentages of the additive cerium, sulfur and oxygen of 1.28, 0.75, and 0.4 respectively. In this case, oxygen and sulfur tied up enough of the cerium to prevent the grain boundary phase at 950° C.

DISCUSSION OF EXAMPLES 11 TO 15

For alloys TIX83, TIX137, TIX138, and TIX139, analyzed chemical compositions converted to atomic fractions indicated that in all cases, the total amount of oxygen and sulfur exceeded the amount of cerium in the alloy. In all of these alloys, grain boundary precipitation of an unstable phase was not detected. In contrast, alloys TIX151, TIX152, and TIX153 all had excess cerium over the amount of sulfur and oxygen in the alloy, based upon an assumption of a nominal oxygen content of 0.2 w/o in each, and using nominal cerium and sulfur levels. Published phase diagram data for the ternary Ti-Ce-S system at 1000° C. shows a liquid phase in the alloy for the case of excess cerium. This data was published by Ageev, Phase Diagrams in Metals (Russian) Moscow, 1973. The addition of aluminum has been reported to lower the temperature for the first appearance of liquid in Ti-Al-Ce alloys with cerium over the solubility limit. Savitskii reports in E. M. Savitskii and G. M. Burkhauov, Zunu. Neorg. Khinic, Vol. 2(11), p. 2609, 1957, that in a 4.5 a/o Al titanium alloy, the maximum solubility for cerium is 0.1 a/o. This is all consistent with my observations of coarse grain boundary phases after 950° C. annealing of alloys with excess cerium.

That alloy TIX152 did not exhibit instability despite the fact that based on nominal additions, the ratio of Ce/(O+S) was 1.5, suggests that some loss or cerium may have occurred during melting, which would reduce the amount of excess cerium.

The binary titanium-yttrium phase diagram disclosed by W. G. Moffatt is "Handbook of Binary Phase Diagrams", published by the General Electric Company, 1976, Schenectady, N.Y. shows a molten phase first appearing at 1355° C. for alloys containing more than 0.9 w/o yttrium. Since yttrium melts above 950° C. in binary titanium alloys excess yttrium alloys may not exhibit the same degree of 950° C. instability as excess cerium alloys.

EXAMPLE #16

Melt extracted ribbon of alloys TIX136, TIX137, and TIX138 were cold pressed into decarburized low carbon steel HIP containers, HIPed at 850° C. and 30 ksi pressure for 3 hrs. After removing the HIP can and machining to a uniform section, the alloys were extruded at a reduction ratio of 7:1 at 850° C. to form bulk alloy. The series of HIP consolidations in which alloys TIX136 through TIX138 were processed showed some porosity after HIP. This was attributed to leakage of the HIP containers. Specimens from this series were tested to determine their tensile strength despite the fact that the small pores in the consolidated alloy could be expected to reduce the apparent strength and ductility of the alloys.

Tensile specimens were machined from the extruded bar. Room temperature tensile testing was performed in air and elevated temperature tests were conducted in vacuum. The as extruded tensile strength of alloys TIX136 and TIX137 over the temperature range of room temperature to 1200° F. are shown in FIG. 1. The dispersoid strengthened alloy has a higher tensile strength up to 1000° F., the highest temperature of testing of that alloy. Alloy TIX136 which has an all alpha-titanium structure is roughly equivalent to the alpha-titanium phase of Ti-6242, an alpha-beta titanium alloy for high temperature applications. The tensile strength of alloy Ti-6242 in the conventional triplex annealed condition is included as the dashed curve in FIG. 1.

Figure 2:
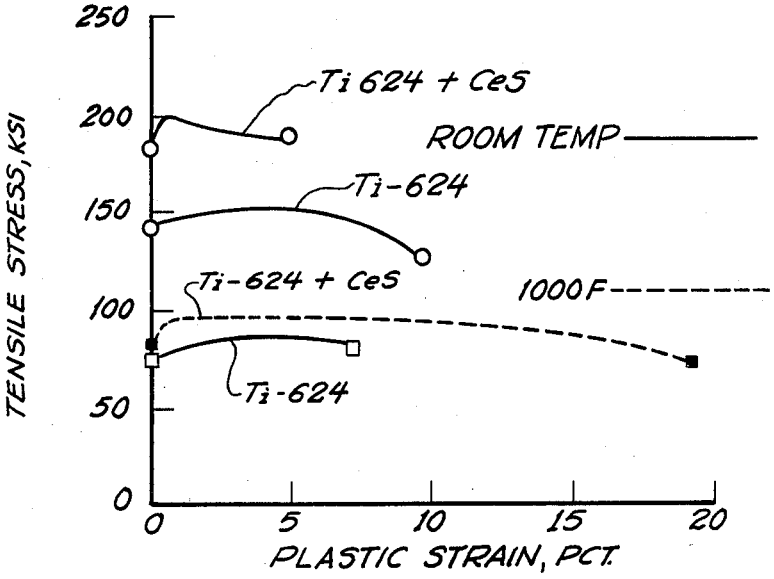
FIG. 2 is a graph in which plastic strain in percent is plotted against stress in ksi.

It can be seen that the cerium-sulfur additions improve room temperature strength significantly and the 1000° F. strength somewhat. Alloy ductility is acceptable at all temperatures as seen in the tensile stress vs. strain curves of FIG. 2. FIG. 2 shows the tensile stress vs. engineering plastic strain at room temperature and at 100° F. for the alloys shown in FIG. 1.

Figure 3:
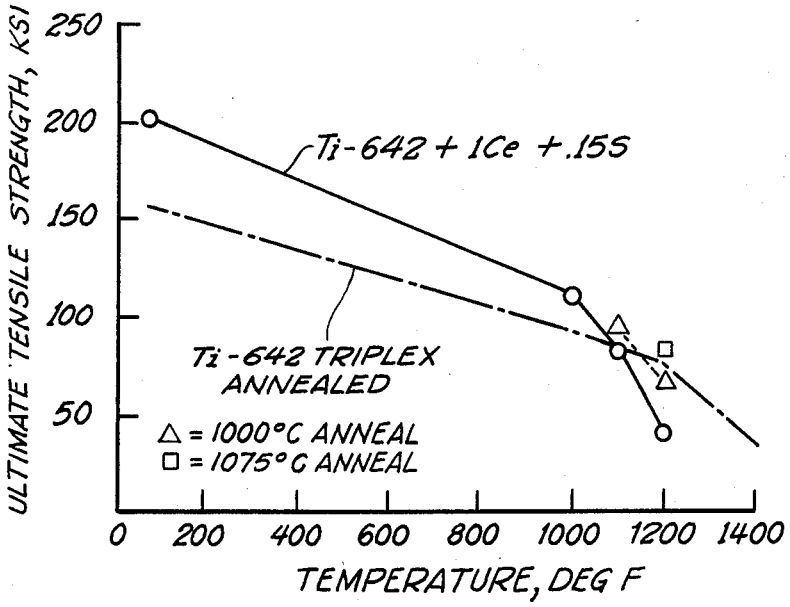
FIG. 3 is a graph similar to that of FIG. 1 but for different metal samples.

The tensile strength of alloy TIX138, Ti-6242 plus cerium-sulfur additions is shown relative to reported values of the tensile strength of Ti-6242 in FIG. 3. The cerium-sulfur doped alloy exhibits higher strength to 100° F. than the data for un-doped alloy Ti-6242, in spite of the fact that during melting of the dispersoid bearing alloy TIX138, some aluminum was lost and the dispersoid bearing alloy has somewhat lower aluminum than Ti-6242. At 1200° F., the dispersoid bearing alloy has lower strength. This was attributed to its much finer grain size than triplex annealed Ti-6242. The dashed line of FIG. 3 is a plot of handbook data for triplex annealed Ti-6242 containing no dispersoid. Annealing the dispersoid bearing alloy at 1000° C. (1832° F.) resulted in a strength improvement at 1100° and 1200° F. The annealed alloy was stronger than triplex annealed Ti-6242 (heat treated for maximum strength and creep resistance at these temperatures) even though the matrix microstructure of the dispersoid bearing alloy had *not* been heat treated for maximum high temperature strength.

The rapid drop-off of the strength of the as-extruded dispersoid bearing alloy at 1100° F. and 1200° F. results from the extremely fine grain size of the alloy. Annealing at 1000° C. produces some grain growth, and hence, greater resistance to high temperature deformation. Annealing the alloy in the beta-titanium phase field overcame the green-growth inhibiting effect of the alpha-beta microstructure of the alloy, and resulted in further strengtening.

Annealing the dispersoid bearing alloy at 1075° C., above the beta phase transus temperature of the base alloy Ti-6242 resulted in further improvement in strength, above that of the triplex annealed Ti-6242 alloy at 1200° F.

Figure 4:
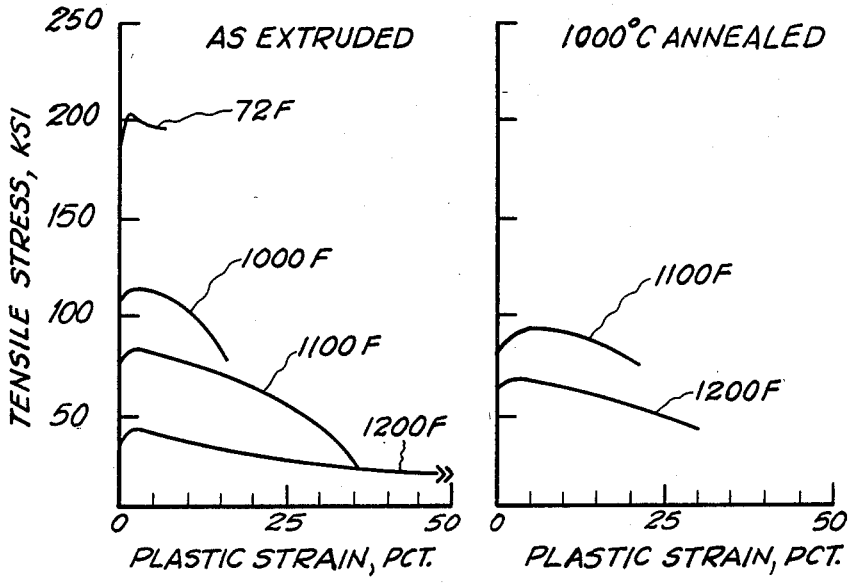
FIG. 4 is a pair of graphs in which plastic strain in percent is plotted against stress in ksi for a sample as extruded and after an anneal at 1000° C.

The ductility of alloy TIX138 in the "as-extruded" condition, and after a 1000° C. anneal can be seen to be good from the tensile stress vs. strain curves shown in FIG. 4. FIG. 4 is a plot of engineering tensile stress vs. engineering plastic strain at various temperatures for "as-extruded" and "1000° C. annealed" alloy TIX138.

SCOPE OF THE INVENTION

The stability of second phase dispersoids in metallic alloys is determined by the relative chemical activities of the constituent elements in the compound and in the alloy matrix. The equilibrium relationship between the constituent elements of the compound in equilibrium with an alloy solid solution may be described simply by noting that for constant activity coefficients the product of the equilibrium concentrations of the two elements in equilibrium with the dispersoid compound must be a constant. This is described for example, for the case of boron and nitrogen in iron by Fountain and Chipman in article "Solubility and Precipitation of Boron Nitride in Iron-Boron Alloys" Trans. Met. Soc. AIME, Vol. 224, pp. 599–606. For cerium and sulfur then, the product [%Ce] [%S] is a constant at a given temperature. As demonstrated by the instability of alloy EB 84, excess sulfur in solid solution leads to the formation of titanium sulfides at internal boundaries. To prevent the concentration of sulfur from exceeding the solubility limit for sulfur in titanium and reprecipitating at internal boundaries, the concentration of cerium in the alloy must be kept high. For this reason, alloys containing cerium sulfide dispersoids should be designed with excess cerium in solid solution in the alloy.

Chemical analysis of alloy EB 83 gives the result that the combined atomic fraction of oxygen and sulfur exceed that required to use up all Ce in the form of the compound $Ce_4O_4S_3$. In spite of this, no evidence of sulfide precipitation at internal boundaries was observed. This suggests that the presence of oxygen modified the thermodynamic relation controlling free sulfur over that in alloys with no oxygen. This is an encouraging result for this line of alloys since it appears to relax the requirement for excess cerium in solution.

Figure 8:
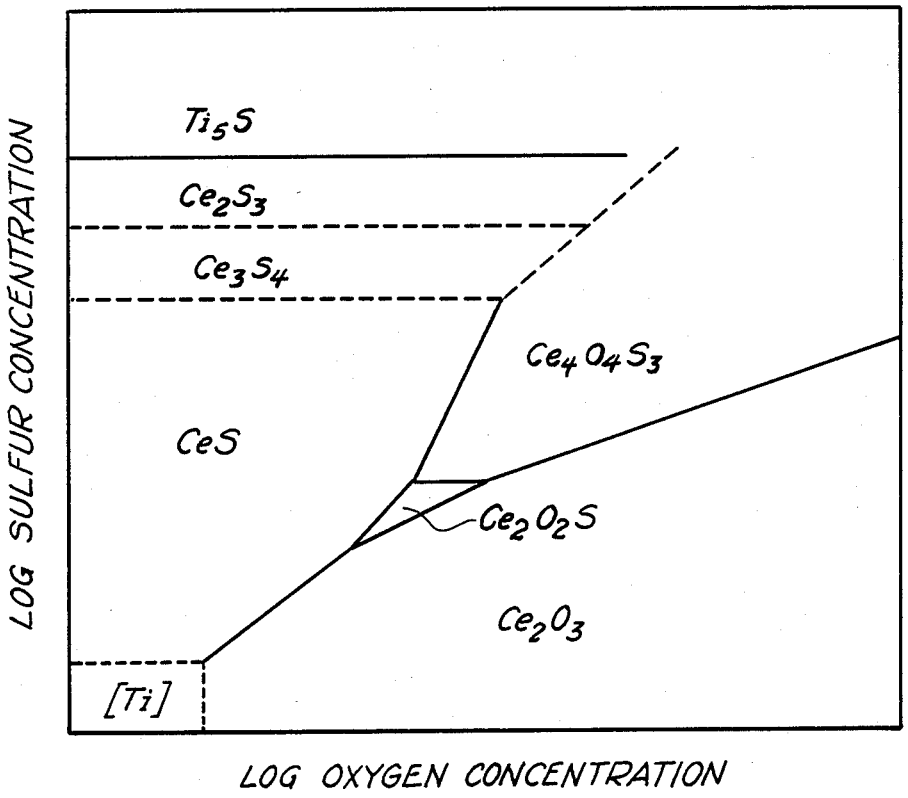
FIG. 8 is a schematic concentration map in which the log of the sulfur concentration is plotted against the log of the oxygen concentration.

Examination of the relative chemical stability of sulfide and oxysulfide phases from the known reactions that can take place between the rare earth, oxygen, sulfur, and titanium and imposing the restraints imposed by reaction in a titanium solid solution leads to a map of sulfur and oxygen contents where each chemical compound should exist relative to other compounds. This is shown in FIG. 8 for the case of cerium, oxygen, and sulfur in a titanium alloy.

The level of cerium in the alloy affects the concentration of sulfur and oxygen in an alloy, but the boundaries between the regions of formation of cerium sulfides and oxysulfides are dependent only upon the concentration of sulfur and oxygen in the alloy. It is generally found for most alloy systems that the chemical activity of sulfur in a metal matrix is unaffected by the presence of small amounts of a second solute species. It can be seen that for most intents, the level of sulfur which determines the formation point for sulfides is independent of the oxygen content. Because of this, the concentration of sulfur in the alloy in equilibrium with cerium is determined only by the total amount of sulfur and cerium in the alloy and the degree of chemical stability of cerium sulfide.

For the case of cerium sulfide, I have experimentally established that titanium sulfide $Ti_5S$ as reported by Ageev or any other titanium sulfide does not form in cerium-sulfur alloys with appropriate addition levels, even after 1000° C. annealing. In fact, the higher sulfide $Ce_3S_4$ also forms without $Ti_5S$ formation. From these experimental results I was able to draw the schematic concentration map of FIG. 8.

Furthermore, since I have established that the yttrium-sulfur system is also stable, it can be generalized with little risk that other rare earth sulfides which form sulfide compounds that are at least as stable chemically as the compound YS per sulfur atom, will also form stable dispersoids in a titanium-rare-earth-sulfur alloy when produced in a manner described in this application.

Gschneidner, "Thermochemistry of the Rare Earth Carbides, Nitrides, and Sulfides for Steelmaking:, Report No. IS-RIC-5, August, 1971, Rare Earth Information Center, Iowa State Univ. Ames, Iowa, has tabulated the free energies of formation of rare-earth sulfides from published heat of formation and heat content data. He indicates that for temperatures up to 1000° C., the sulfides of gadolinium, cerium and calcium have free energies lower than that of yttrium sulfide, YS. Praesodynium and lanthanum are comparable to YS in stability, and strontium may be more stable. However, data on strontium sulfide stability is limited only to room temperature. I am not aware of published data on the free energy of formation of the sulfide ErS. My experiments on the stability of the erbium-sulfur system suggest that the sulfide ErS does not have comparable chemical stability to YS, however.

The concentration of the several metals which may be employed in the practice of the present invention when expressed in atomic percent is between 0.5 and 2.5 atomic percent. A preferred range is between 0.8 and 1.8 atomic percent.

The concentration of sulfur which may be employed in practice of the present invention when expressed in atomic percent may be varied between 0.2 atomic percent and 1.8 atomic percent.

The amount of sulfur used is related to the amount of metal so that when the percentage of metal used is higher the percentage of sulfur employed is correspondingly higher. Oxygen is also present in the dispersoid formed as is expressed above.

Based on my experimental results taken in conjunction with thermodynamic considerations it is my conclusion that the scope of my invention includes other rare earths with monosulfide chemical stability greater than that of YS. In particular, it should include SrS, PrS, and LaS. Furthermore, the sulfide CaS has better stability than YS and hence CaS as a stable dispersoid in titanium alloy is also included within the scope of my invention.

Although data on the free energy of other rare-earth sulfides is not available, it is easy to generalize that with a simple sulfide stability test, more rare earth-sulfur systems can be identified which form stable dispersoids in titanium alloys.

A summary of the invention described herein is that a compound such as CeS has been found to exhibit sufficient chemical stability in titanium alloys to be useful as a dispersoid in titanium alloys when the alloy is produced by a rapid solidification process. In addition, thermodynamic arguments for the avoidance of sulfide embrittlement require that the alloy contain excess cerium and oxygen over that required to tie up the sulfur in the alloy as cerium sulfides or oxysulfides. An alloy so produced has been demonstrated to have sufficient thermal stability of the fine dispersoid to withstand an anneal of 950° C. for one hour without sulfide compound dissociation or gross particle coarsening.

What is claimed is:

1. A titanium base alloy containing 6 weight percent aluminum, 2 weight percent tin and 4 weight percent zirconium, said alloy having distributed therein a fine dispersoid of a metal compound of high chemical stability, said compound being formed of at least one metal and at least one nonmetal, said nonmetal being oxysulfide, said metal being selected from the group consisting of calcium, strontium and a rare earth metal, and said rare earth metal being one which forms with said nonmetal a compound having a chemical stability greater than that of the corresponding compound of yttrium.

2. The alloy of claim 1 in which the dispersoid particle size is principally from 50 to 3000 Angstroms and the particles are principally spaced less than approximately 0.4 to 0.5 microns apart, and the dispersoid particles consist predominantly of the compound $Ce_4O_4S_3$.

3. A titanium base alloy containing appreciable concentrations by weight percent of aluminum, tin and zirconium, said alloy having distributed therein a fine dispersoid of a metal compound of high chemical stability, said compound being formed of at least one metal and at least one nonmetal, said nonmetal being oxysulfide, said metal being selected from the group consisting of calcium, cerium, gadolinium, praesodynium, lanthanum, yttrium and strontium.

4. A titanium base alloy solution strengthening alloy elements dissolved therein and said alloy having distributed therein a fine dispersoid of a metal compound of high chemical stability, said compound being formed of at least one metal and at least one nonmetal, said nonmetal being oxysulfide, said metal being cerium.

5. The method of forming a titanium base alloy having improved strength at high temperatures which comprises, introducing a highly stable compound into a melt of the titanium base alloy, having appreciable concentrations of alloying elements therein, said compound being formed of at least one metal and at least one nonmetal, said nonmetal being oxysulfide, said metal being selected from the group consisting of calcium and strontium and a rare earth metal, said rare earth metal being one which forms with said nonmetal a compound of dispersoid particles having a chemical stability greater than that of the corresponding compound of yttrium and rapidly solidifying the melt.

6. The method of claim 5 in which the dispersoid particles consist predominantly of the compound $Ce_4O_4S_3$.

7. The method of forming a titanium base alloy having improved strength at high temperatures which comprises providing an alloy containing 6 weight percent aluminum, 2 weight percent tin and 4 weight percent zirconium, introducing cerium sulfide into a melt of said alloy and rapidly solidifying the alloy from the melt to form dispersoid particles consisting predominantly of the compound $Ce_4O_4S_3$.

* * * * *